United States Patent [19]

Rhode

[11] Patent Number: 4,785,613

[45] Date of Patent: Nov. 22, 1988

[54] GRASSCATCHER BAG FABRIC

[75] Inventor: Werner Rhode, Greenville, S.C.

[73] Assignee: Milliken Research Corporation, Spartanburg, S.C.

[21] Appl. No.: 107,695

[22] Filed: Oct. 13, 1987

[51] Int. Cl.[4] ..... D04B 21/00

[52] U.S. Cl. ..... 56/202; 66/195

[58] Field of Search ..... 56/202, 320.2; 66/196, 66/190, 192, 193, 195, 196, 170

[56] References Cited

U.S. PATENT DOCUMENTS

| | | | |
|---|---|---|---|
| 459,866 | 9/1891 | Clewley | 66/196 |
| 1,666,638 | 4/1928 | Bennett | 66/195 |
| 2,263,787 | 11/1941 | Safferson | 66/170 |
| 3,107,510 | 10/1963 | Manger | 66/196 |
| 3,331,221 | 7/1967 | Lawson, Jr. | 66/170 |
| 3,527,037 | 9/1970 | Leader | 56/202 |
| 3,583,138 | 6/1971 | Mattson | 56/202 |
| 3,611,685 | 10/1971 | Allina | 56/202 |
| 3,762,186 | 10/1973 | Kohl | 66/190 |
| 3,866,443 | 2/1975 | Hunneke et al. | 66/194 |
| 4,015,443 | 4/1977 | Luchi | 66/190 |
| 4,079,602 | 3/1978 | Blore | 66/196 |
| 4,125,001 | 10/1978 | Bryars | 66/190 |
| 4,409,802 | 10/1983 | Matsuda | 66/193 |
| 4,518,640 | 5/1985 | Wilkens | 66/192 |
| 4,615,934 | 10/1986 | Ellison | 66/190 |

*Primary Examiner*—John Weiss

*Attorney, Agent, or Firm*—H. William Petry; Earle R. Marden

[57] ABSTRACT

A 3-bar Raschel warp knit fabric for use in grasscatcher bags which has an additional yarn knit in to provide a lower elongation yarn in the course direction to prevent the grasscatcher bag from dragging the ground as it is being filled.

15 Claims, 2 Drawing Sheets

*FIG. —1—*

GRASSCATCHER BAG FABRIC

This invention relates to a knit fabric for use in grasscatcher bags which requires high tenacity or strength for impact but has reduced elongation so it does not drag the ground in use.

It is an object of the invention to provide a warp knit, high tenacity fabric for use in grasscatcher bags which has substantially lower elongation in the course or fill direction.

Other objects and advantages of the invention will become readily apparent as the specification proceeds to describe the invention with references to the accompanying drawings, in which.

Figure 1:
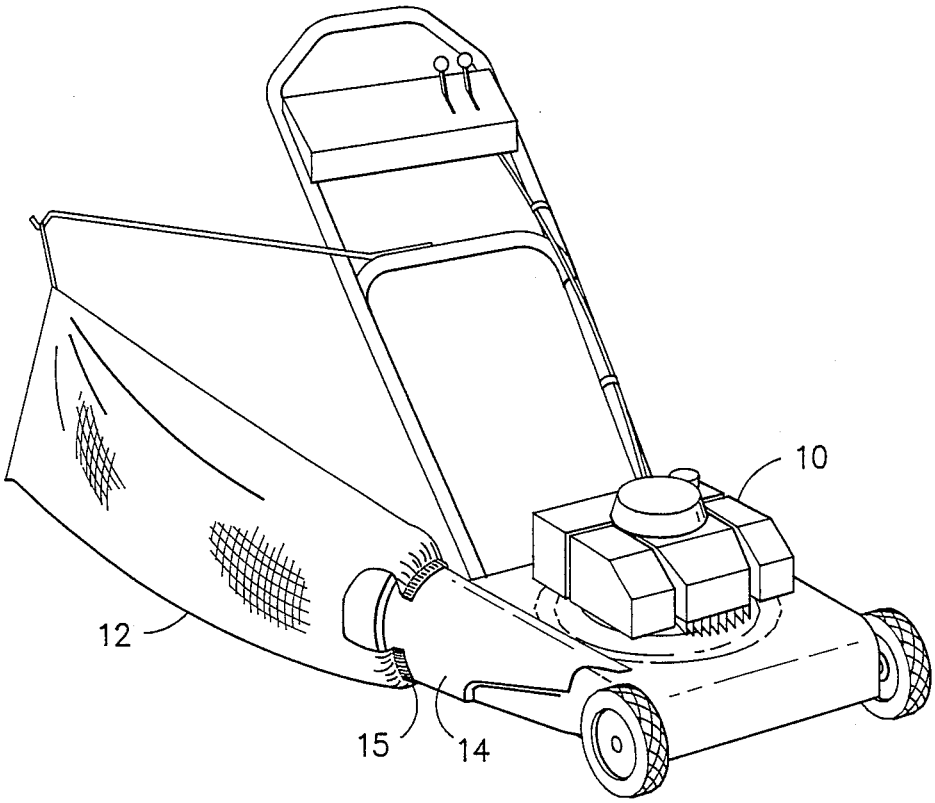
FIG. 1 is a perspective view of a lawn mower with a grasscatcher bag attached thereto which is made from the new and improved warp knit fabric.

Looking now to FIG. 1 there is shown a conventional lawn mower 10 with a grasscatcher bag 12 connected to the discharge chute 14 thereof. The lawn mower 10 is shown as a push style but obviously other mowers such as a riding mower could employ the bag 12 on the discharge thereof. The grasscatcher bag 12 has a suitable snap-on collar or band 15 around the course or fill direction of the fabric to engage the circumference of the discharge chute 14.

The standard grasscatcher bag is made from high tenacity yarn (840–1300 den.) in order to pass the performance requirements set by the Outdoor Power Equipment Institute but tends to elongate and stretch when subjected to load as the bag fills up. The standard grass catcher bag shown in FIG. 1 typically is formed by forming a flat fabric into a tube shape and sewing the edges thereof together. The bag tends to sag and sometimes drags the ground. To prevent this condition the herein developed fabric has been developed.

Figure 2:
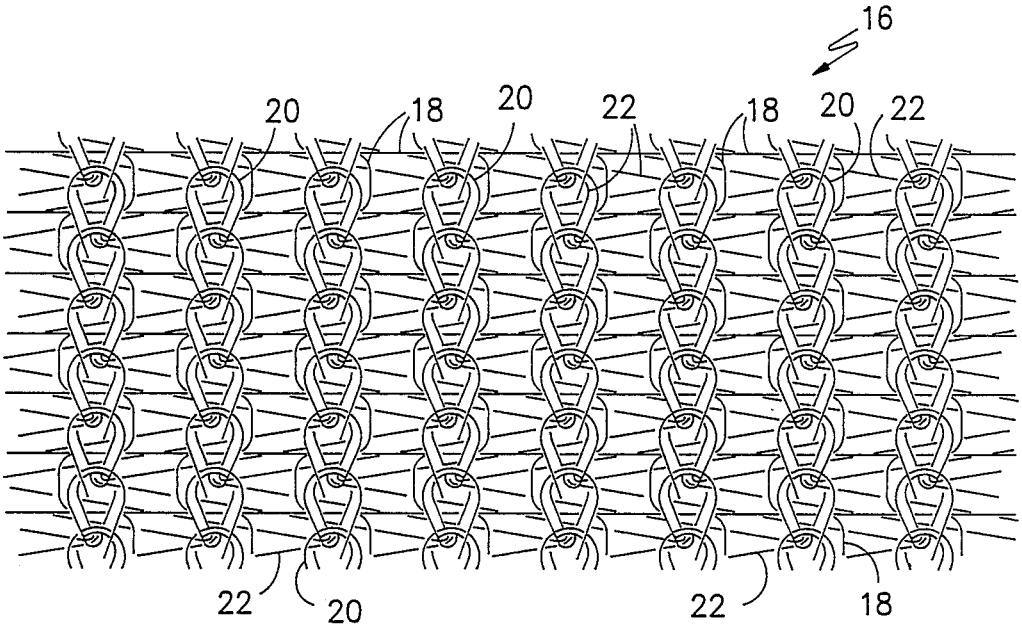
FIG. 2 is a blow-up view of the new and improved fabric.
Figure 3:
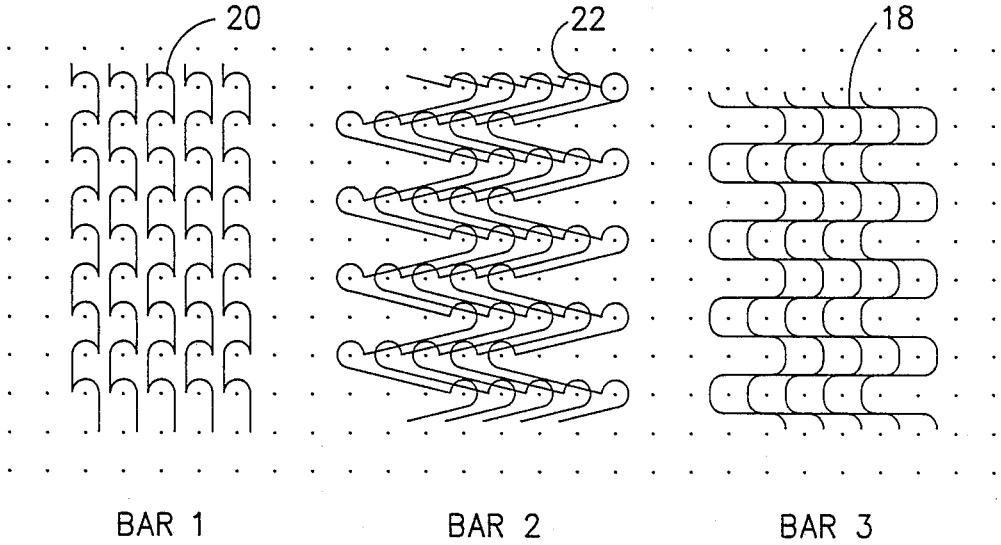
FIG. 3 is a point diagram of the fabric shown in FIG. 2.

The warp knit fabric 16 used in the construction of the bag 12 is a 3-bar Raschel warp knit fabric with the additional bar knitting in a lower elongation yarn in the course or full direction. As shown in FIGS. 2 and 3, bar 3 which is knitting a 150 denier polyester yarn 18 provides lower elongation in the course or fill direction while bars 1 and 2 knitting a high tenacity 1000 denier polyester yarn 20 and 22 maintain the required tensile strength in the bag 12.

To provide the particular fabric 16 the yarn on bar 1 is knitting a 1-0/0-1 pattern which is a conventional chain stitch, the yarn on bar 2 is knitting a 4-3/0-1 pattern which is a conventional multiple needle lap stitch and the yarn on bar 3 is knitting 0-0/2-2. It should be noted that each adjacent wale is connected to the next adjacent wale by the yarn 18 to inhibit elongation of the fabric in the course or fill direction without inhibiting the overall tensile strength of the fabric. In describing the fabric 16 the terms fill and course direction are used interchangeably while the term wale and warp direction are used interchangeably. By the terms fill or course direction it is meant the widthwise direction of the fabric as it is being knit and the warp or wale direction is the machine direction of the fabric.

The disclosed fabric and a typical standard commercial grasscatcher bag fabric were tested for physical characteristics and the following data was obtained for comparison.

| | Standard | New Fabric |
|---|---|---|
| Width | 47.90 | 47.80 |
| Weight | 14.56 | 15.08 |
| Wales/Inch | 10.30 | 10.50 |
| Courses/Inch | 10.00 | 10.00 |
| Tensile at Break | | |
| Warp | 524 Lbs. | 615 Lbs. |
| Fill | 446 Lbs. | 535 Lbs. |
| Elongation at Break | | |
| Warp | 33.70% | 36.30% |
| Fill | 105.10% | 107.80% |

| Filling Elongation at Low Load | | |
|---|---|---|
| 1 Lb. | 10.93% | 1.00% |
| 2 Lbs. | 20.30% | 3.14% |
| 3 Lbs. | 26.30% | 4.31% |
| 4 Lbs. | 29.40% | 5.23% |
| 5 Lbs. | 31.60% | 6.66% |
| 6 Lbs. | 33.80% | 10.59% |
| 7 Lbs. | 34.90% | 12.62% |
| 8 Lbs. | 36.30% | 15.77% |
| 10 Lbs. | 39.30% | 18.50% |
| 15 Lbs. | 43.50% | 24.00% |
| 20 Lbs. | 46.50% | 27.70% |
| 25 Lbs. | 48.40% | 29.60% |
| 50 Lbs. | 54.70% | 37.40% |
| 75 Lbs. | 59.10% | 41.50% |
| 100 Lbs. | 62.90% | 46.00% |

Warp elongation under low load is identicalf for both products.

It is obvious that the above described fabric provides substantially lower elongation at low loads so that the grasscatcher bag made therefrom will be sturdier but at the same time maintains the warp tensile strength to prevent objects from being thrown through the bag material.

Although the preferred embodiment of the invention has been described specifically it is contemplated that many changes may be made without departing from the scope or spirit of the invention and it is desired that the invention be limited only by the scope of the claims.

I claim:

1. Apparatus to mow a lawn comprising: a lawn mower with a discharge outlet and a grasscatcher bag connected to said outlet, said grasscatcher bag being made of a warp knit fabric having a plurality of chain stitches interknit with a plurality of multiple needle lap stitches with adjacent wales connected to one another with a yarn having lower elongation characteristics than the other yarns in said fabric to reduce the elasticity of the fabric at low load conditions in the course direction of the fabric.

2. The bag of claim 1 wherein said warp knit fabric is a 3-bar fabric.

3. The bag of claim 2 wherein said lower elongation yarn is knit on one bar in a 1-0/0-1 pattern.

4. The bag of claim 3 wherein the other two bars are knitting, respectively, in a 4-3/0-1 and an 0-0/2-2 pattern.

5. The bag of claim 4 wherein substantially all of said yarns are polyester.

6. The bag of claim 5 wherein the denier of lower elongation yarns is about 150 denier.

7. The bag of claim 6 wherein the denier of the yarns of said fabric other than the lower elongation yarn is in the range of 840–1300.

8. The bag of claim 7 wherein said denier of said other yarns is about 1000 denier.

9. A grasscatcher bag for a lawn mower comprising: a 3-bar warp knit fabric formed into tubular form with the course direction extending around the diameter of the tube and the wale direction extending longitudinally of the tube, having a plurality of chain stitches interknit with a plurality of multiple needle lap stitches with adjacent wales connected to one another with a yarn having lower elongation characteristics than the other yarns in said fabric to reduce the elasticity of the fabric at low load conditions in the course direction of the fabric.

10. The bag of claim 9 wherein said lower elongation yarn is knit on one bar in a 1-0/0-1 pattern.

11. The bag of claim 10 wherein the other two bars are knitting, respectively, in a 4-3/0-1 and an 0-0/2-2 pattern.

12. The bag of claim 11 wherein substantially all of said yarns are polyester.

13. The bag of claim 12 wherein the denier of lower elongation yarns is about 150 denier.

14. The bag of claim 13 wherein the denier of the yarns of said fabric other than the lower elongation yarn is in the range of 840–1300.

15. The bag of claim 14 wherein said denier of said other yarns is about 1000 denier.

* * * * *